US006654570B2

(12) United States Patent
Kato

(10) Patent No.: US 6,654,570 B2
(45) Date of Patent: Nov. 25, 2003

(54) IMAGE FORMING APPARATUS WITH VARIOUS VOLTAGE LEVELS APPLIED TO TRANSFERRING MEMBER

(75) Inventor: Hironori Kato, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,358

(22) Filed: Oct. 30, 2001

(65) Prior Publication Data

US 2002/0051647 A1 May 2, 2002

(30) Foreign Application Priority Data

Oct. 30, 2000 (JP) ..... 2000-331173
Oct. 19, 2001 (JP) ..... 2001-322652

(51) Int. Cl.[7] ..... G03G 15/16
(52) U.S. Cl. ..... 399/66; 399/45
(58) Field of Search ..... 399/45, 66, 313, 399/314, 85

(56) References Cited

U.S. PATENT DOCUMENTS 5,012,293 A * 4/1991 Aldrich et al. ..... 399/66
5,697,015 A * 12/1997 Ream et al. ..... 399/66
5,884,121 A * 3/1999 Kyung ..... 399/66
5,953,556 A * 9/1999 Yamanaka ..... 399/66
6,070,024 A * 5/2000 Oono ..... 399/66
6,205,299 B1 * 3/2001 Kusaka et al. ..... 399/45
6,334,032 B1 * 12/2001 Tomiki ..... 399/66
6,356,720 B1 * 3/2002 Yoshioka ..... 399/66
6,370,345 B2 * 4/2002 Sasai ..... 399/101

* cited by examiner

*Primary Examiner*—Robert Beatty
(74) *Attorney, Agent, or Firm*—Fitzpatrick, Cella, Harper & Scinto

(57) ABSTRACT

An image forming apparatus has an image bearing member; a transferring member for transferring a toner image from the image bearing member onto a recording material at a transfer portion; and a voltage applicator for applying a voltage to the transferring member The voltage applicator is capable of applying to the transferring member a first voltage, a second voltage higher than the first voltage and a third voltage higher than the second voltage; and the voltage applicator applies the first voltage to the transferring member, then the second voltage prior to the recording material reaching the transfer portion, and then the third voltage after the recording material reaching the transfer portion.

18 Claims, 8 Drawing Sheets

IMAGE FORMING APPARATUS WITH VARIOUS VOLTAGE LEVELS APPLIED TO TRANSFERRING MEMBER

FIELD OF THE INVENTION AND RELATED ART

The present invention relates to an image forming apparatus such as a printer, copying machine, facsimile machine or the like.

Referring first to FIG. 7, there is shown a structure of a transfer portion of an image forming apparatus such as a printer according to a background art.

The photosensitive drum 1 is rotated in the direction indicated by an arrow R1, and a toner image is formed thereon by charging means, exposure means and developing means (unshown). The toner image is transferred onto a recording material such as paper by a transfer roller (transferring means).

The transfer roller 2 is contacted to the photosensitive drum 1 to form a transfer nip T therebetween. The transfer roller 2 is supplied with a high voltage (transfer bias) from a high voltage source (transfer bias application voltage source). The voltage applied to the transfer roller 2 is controlled through a predetermined sequence by control means 4, and the current flowing through the transfer roller 2 is detected by current detecting means 5. Upstream of the transfer nip T along a feeding path 6 of the recording material, there is provided a sensor 7 for detecting leading and trailing edges of the recording material fed in the direction indicated by an arrow Kp. The distance from the sensor 7 to the transfer nip T is set to L.

FIG. 8 shows a voltage applied to the transfer roller 2 when the printing (image formation) is carried out on one recording material. The abscissa represents time, and ordinate represents presence or absence of the recording material and the voltage (transfer bias).

The time 0 corresponds to the time when the user instructs the printing operation. The control means 4 adjusts the voltage such that current detected by the current detecting means 5 is a predetermined value. The current is 2 $\mu$A, for example. Since the resistance value of the transfer roller 2 varies depending on the ambient conditions under which the apparatus is used and on the transfer rollers, the voltage is adjusted to provide a proper current for image transfer operation. The voltage required for flowing the current suitable for the image transfer is designated by C in FIG. 8. The high voltage source 3 is controlled at time A which is t1 after C, such that voltage D is applied from the point of time (time a) when the sensor 7 detects the presence of the sheet after the recording material is fed to the point of time at which the recording material reaches the transfer nip T. At the time when the sensor 7 detects the absence of the recording material (time b) is deemed as being the point of time at which the trailing-edge of the recording material passes, and the high voltage source 3 is controlled at time B t2 thereafter, such that voltage restores to C prior to the trailing edge of the recording material passes the transfer nip T. When the printing is finished, the output of the voltage is stopped at proper timing.

The voltage is raised during the recording material being material transfer nip T, in order to compensate the reduction of the current which otherwise occurs because of the existence of the recording material in the transfer nip T. The voltage D is not applied from the initial stage, because the high voltage across the transfer nip T without the recording material in the need may damage the photosensitive drum 1. In order to prevent such damage, the setting is selected so as to assure that voltage D is reached only after the recording material come into the transfer nip T, even when the rising time F is minimum.

However, due to the increasing printing speed of the image forming apparatus and compatibility with a variety of media, there is a tendency that voltage D required for the printing is increasing with a result of the increasing rising time F from the setting of the high voltage to the actual arrival at the voltage D. The timing at which the output of the high voltage source 3 is changed is selected such that voltage D is not applied in the absence of the recording material in the transfer nip T, and therefore, there is a liability that output of the high voltage source 3 is not sufficiently high to the point of time when the leading edge of the recording material reaches the transfer nip T. In such a case, the toner is not sufficiently transferred from the photosensitive drum to the recording material after the leading-edge of the recording material to the arrival of the voltage from the high voltage source 3 at voltage D (image defect of transfer void). If, on the other hand, voltage D is too high, the toner jumps so vigorously at the recording material that image defect occurs due to the so-called scattering of the toner.

SUMMARY OF THE INVENTION

Accordingly, it is a principal object of the present invention to provide an image forming apparatus in which the rising of the voltage is made quick to avoid the transfer void without damaging the image bearing member.

It is another object of the present invention to provide an image forming apparatus in which scattering of the image attributable to the too high voltage, is effectively prevented.

According to an aspect of the present inventions, there is provided an image forming apparatus comprising an image bearing member; a transferring member for transferring a toner image from said image bearing member onto a recording material at a transfer portion; voltage applying means for applying a voltage to said transferring member; wherein said voltage applying means is capable of applying to the transferring member a first voltage, a second voltage higher than the first voltage and a third voltage higher than the second voltage; wherein said voltage applying means applies the first voltage to the transferring member, then the second voltage prior to the recording material reaching the transfer portion, and then the third voltage after the recording material reaching the transfer portion.

According to another aspect of the present invention, there is provided an image forming apparatus comprising an image bearing member; a transferring member for transferring a toner image from said image bearing member onto a recording material at a transfer portion; voltage applying means for applying a voltage to said transferring member; wherein said voltage applying means is capable of applying to the transferring member a first voltage, a second voltage higher than the first voltage and a third voltage higher than the second voltage: said voltage applying means is operable in a first mode in which said voltage applying means applies to said transferring member the first voltage, then the second voltage prior to the recording material reaching said transfer portion, and then the third voltage after the recording material reaching said transfer portion, and in a second mode in which said voltage applying means applies to said transferring member the first voltage, then the second voltage prior to the recording material reaching said transfer portion, and then the second voltage after the recording material reaching the transfer portion, too; and switching means for switching between the first mode and the second mode.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 1:
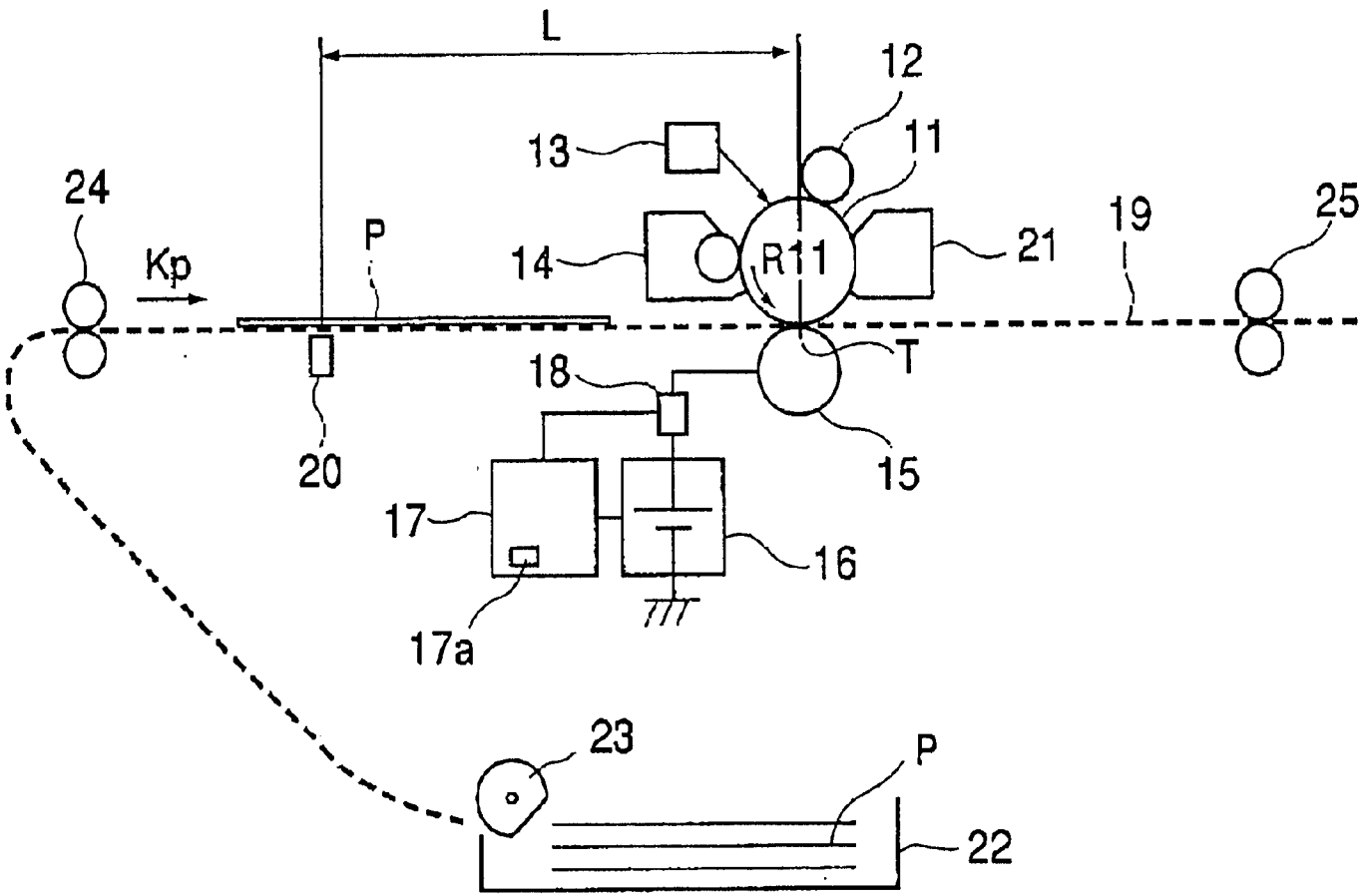
FIG. 1 is a schematic illustration of an image forming apparatus according to an embodiment of the present invention.

FIG. 1 illustrates an example of an image forming apparatus according to an embodiment of the present invention.

This Figure is a longitudinal sectional view of the apparatus which is a printer.

The printer includes an electrophotographic photosensitive member (image bearing member) in the form of a drum (photosensitive drum) 11.

The photosensitive drum 11 make comprises an electroconductive drum base member of aluminum or the like, and an OPC (organic light semiconductor) provided on the outer surface of the drum base member as a photosensitive layer. The photosensitive drum 11 is driven in the direction indicated by an arrow R11 by a driving means (unshown) at a predetermined process speed (peripheral speed).

Around the photosensitive drum 11, there are provided charger (charging means) 12 having a charging roller (charge member), an exposure device (exposure means) 13, a developing device (developing means) 14, a transfer device (transferring means) 15 having a transfer roller (transferring member), and a cleaner (cleaning means) 21, in the order named along the periphery of the photosensitive drum 11. The transfer roller 15 is connected with a high voltage source (transfer bias application voltage source) 16 which is in turn connected with a control means 17. Between the transfer roller 15 and the high voltage source 16, there is a current detecting means 18 connected with the control means 17. The transfer roller 15 is contacted to the bottom portion of the surface of the photosensitive drum 11 to form a transfer nip (transfer portion) T between itself and the photosensitive drum 11. In the shown image forming apparatus, the feeding path 19 for the recording material extends from the left side to the right-hand side, and a recording material sensor (recording material detecting means) 20 for detecting the recording material is disposed upstream of the transfer nip T with respect to the recording material feeding direction (arrow Kp). The distance between the transfer nip T and the recording material sensor 20 is set at L. Designated by 22 is a sheet feeding tray; 23 is a sheet feeding roller (sheet feeding means); 24 is a registration roller (registration means). The recording material is picked up by the sheet feeding roller 23 from the sheet feeding tray 22, and is fed to the registration roller 24 where the recording material is temporarily stopped for synchronization with the image on the photosensitive drum 11. Thereafter, the recording material is fed into the transfer nip T by the registration roller 24 which is started in response to a synchronizing signal thereafter.

The description will be made as to operations of the image forming apparatus having the above-described structure. When the user instructs the printing operation (image formation), that is, a print starting signal is produced, the photosensitive drum 11 is rotated in the direction indicated by an arrow R11 by driving means (unshown). The surface of the photosensitive drum 11 is uniformly charged to a predetermined potential of a predetermined polarity by the charging roller 12. The surface of the photosensitive drum 11 after the electrical charging, is exposed to image light by the exposure device 13 so that and electrostatic latent image is formed. Electrostatic latent image is developed with toner by the developing device 14 into a toner image. The toner image thus formed on the surface of the photosensitive drum 11 is transfer onto a recording material P supplied into the transfer nip T along the feeding path 19 in the direction indicated by the arrow Kp, by application of the transfer bias voltage to the transfer roller 15. The photosensitive drum 11 after the toner image transfer is clean by a cleaner 21 such that toner remaining on the surface thereof is removed, so that photosensitive drum 11 is prepared for the next image formation. On the other hand, the recording material P after the toner image transfer is subjected to heat and pressure by the fixing device 25 so that toner image is fixed on the surface of the recording material P. After the toner image fixing, the recording material P is discharged to an outside of the main assembly of the image forming apparatus, was finishing the printing (image forming) operation.

Figure 2:
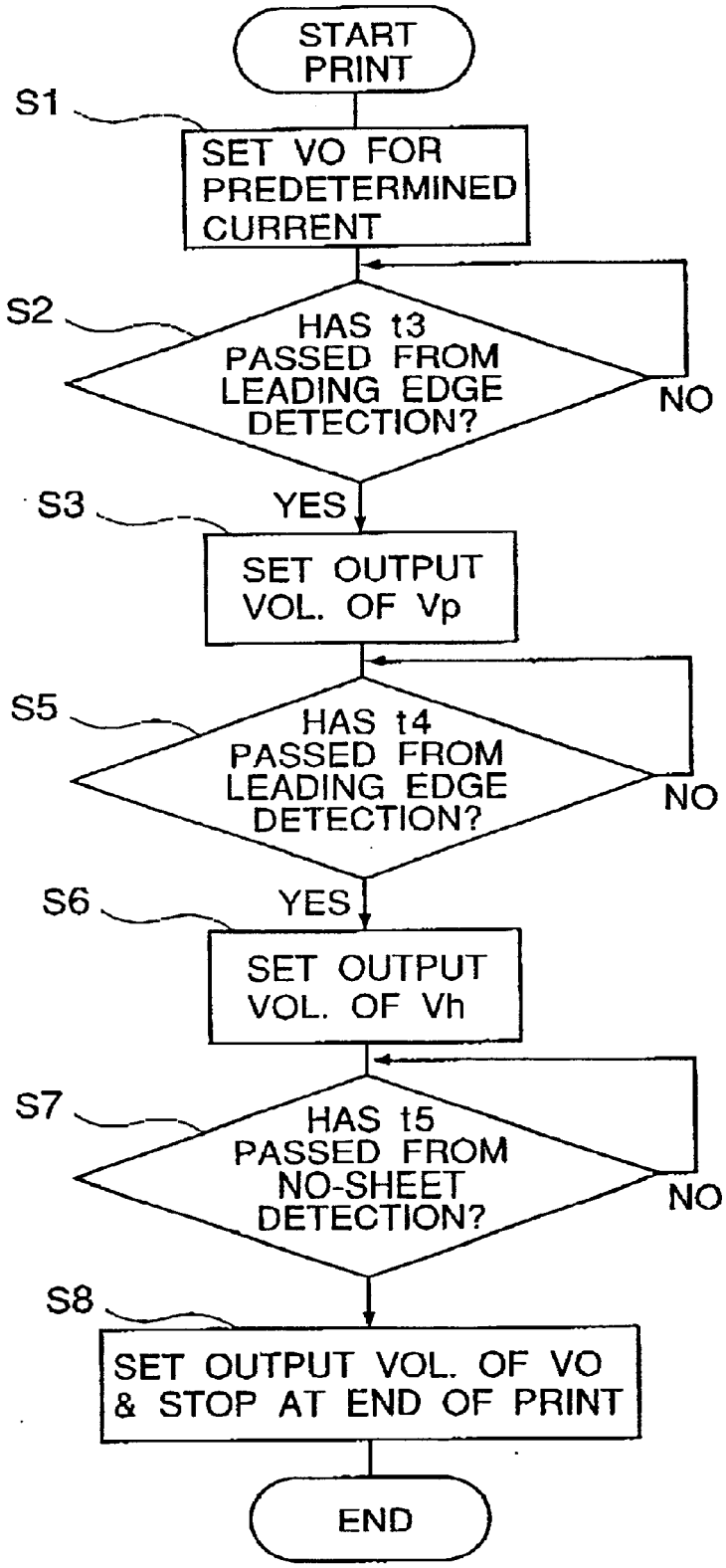
FIG. 2 is a flow chart of a transfer bias control used in this embodiment.
Figure 3:
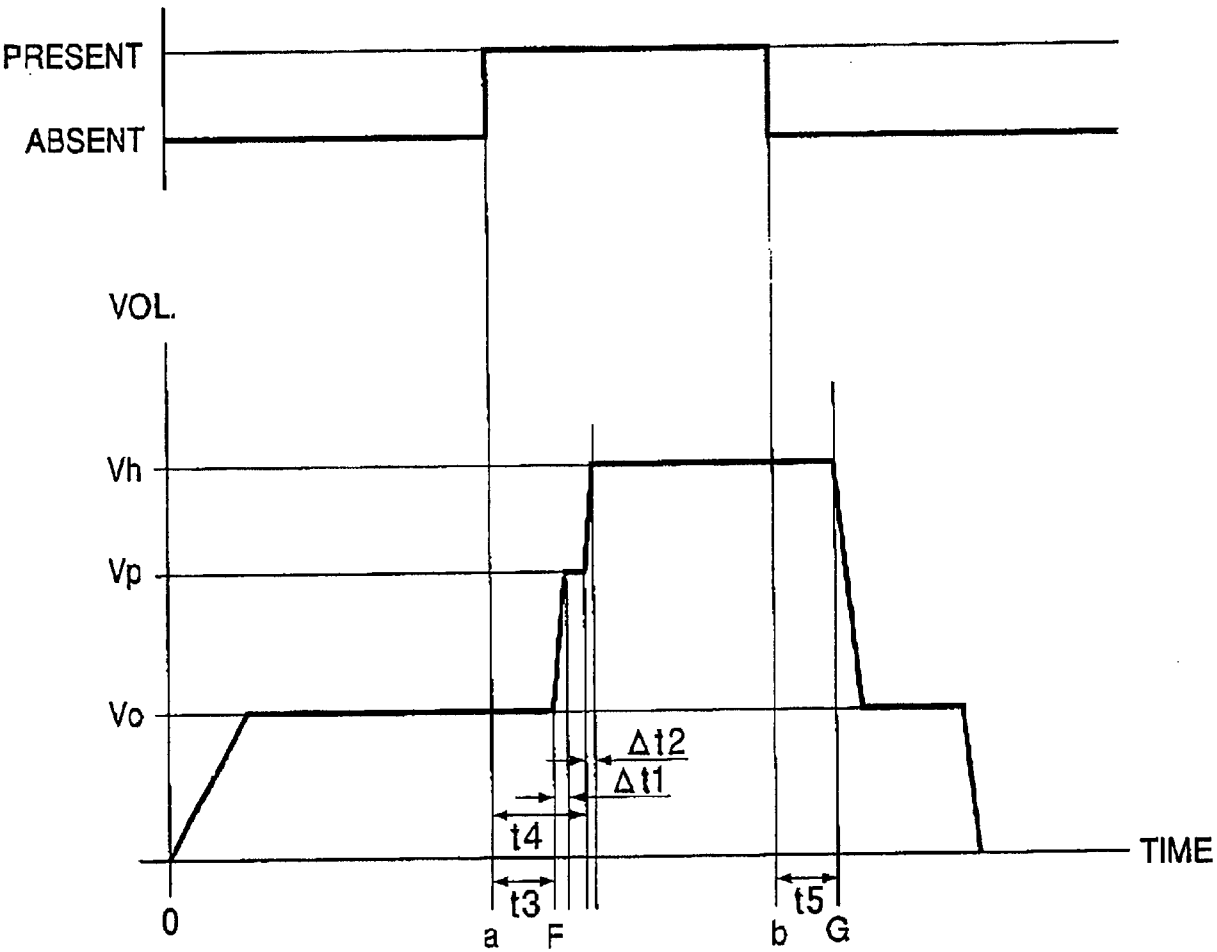
FIG. 3 is a timing chart of application of a transfer bias in this embodiment.

Referring to FIGS. 1, 2 and 3, 2 Embodiment 1 will be further described. FIG. 1 is a schematic illustration of the image forming apparatus, as stated hereinbefore, FIG. 2 is a flow chart of operation, and FIG. 3 is a timing chart.

Prior to the image transfer operation of the toner image from the surface of the photosensitive drum 11 onto the recording material P after the print start signal, the control means 17 activate the high voltage source 16 and effects control such that current through the current detecting means 18 is at a predetermined level. The voltage (first voltage) at which the current flowing through the current detecting means 18 is the predetermined level (VO at S1 in FIG. 2) is stored in voltage storing means 17*a*. Generally speaking, the resistance value of the transfer roller 15 varies depending on the individual rollers, the ambient condition difference such as a temperature and a humidity. The range of variation is approximately from 400 MΩ to 2000 MΩ. Therefore, at the start of printed operation, the voltage is preferably adjusted by the above-described step S1.

Subsequently, the voltage VO is maintained until the recording material sensor 20 detects the recording material P. The timing at which the recording material sensor 20 detects the sheet (presence of the recording material), that is, the timing at which the output signal is produced by the recording material sensor (a reference signal for the transfer voltage control), is indicated by time an in FIG. 3. At time F which is t3 thereafter (S2), the control means 17 controls the high voltage source 16 such that high voltage source 16 produces a voltage Vp (second voltage) which is higher than the voltage VO (S3). The voltage Vp will be described in detail hereinafter. Here, t3 is set to be the time prior to the recording material P is nipped by the transfer nip T, more particularly, it is set to satisfy t3<L/S where L is a distance between the recording material sensor 20 and the transfer nip T, and S is a feeding speed of the recording material. At the timing (S5) which is t4 after the timing (time a) at which the recording material sensor 20 detects the sheet, the control means 17 sets the high voltage source 16 so as to produce a voltage Vh (voltage vh) which is higher than Vp (S6). Here, the t4 is selected such that recording material P is nipped in the transfer nip T, that is, t4 satisfies t4≧L/S.

Thereafter, at time G (S7) which is t5 after the time b at which the recording material sensor 20 detects the absence of the recording material, the control means 17 sets the high voltage source 16 so as to produce the voltage VO (S8), and the high voltage source 16 is deactivated upon the finishing of the printing operation. Indicated by Fair t1 in FIG. 3 is a rising time period required for raising the voltage from VO to Vp, and Fair t2 is a rising time period required for raising the voltage from Vp to Vh. Here, if the voltage Vp is set to be close to the maximum value within the range in which a drum memory is not produced in the photosensitive drum 11, the time t3 can be relatively short, and the time duration from the arrival of the recording material at the transfer nip T to the arrival of the output of the high voltage source 16 at Vh can be minimized. And, Vp=A×VO+B where An is a predetermined constant (positive), and B is 0 or a predetermined constant (positive), and Vh=C×VO+D where C, D are predetermined constants determined so as to satisfy Vh≧Vp within the variation range of the voltage VO).

As described in the foregoing, according to this embodiment of the present invention, when the voltage produced by the high voltage source 16 is raised to a high level, the voltage is first raised to a predetermined voltage Vp prior to the recording material reaching the transfer nip T, and the voltage is then raised to the final target voltage Vh when the recording material is assuredly present in the transfer nip T. Thus, the voltage is stepwisely raised. Therefore, the damage of the photosensitive drum attributable to the application of the high voltage in the absence of the recording material in the transfer nip T, can be avoided. Additionally, the voltage can be quickly raise to the high voltage Vh, and the so-called transfer void attributable to insufficient transfer of the toner onto the recording material from the photosensitive drum 11 in the period before the high voltage Vh is produced, can be avoided.

Embodiment 2

Figure 4:
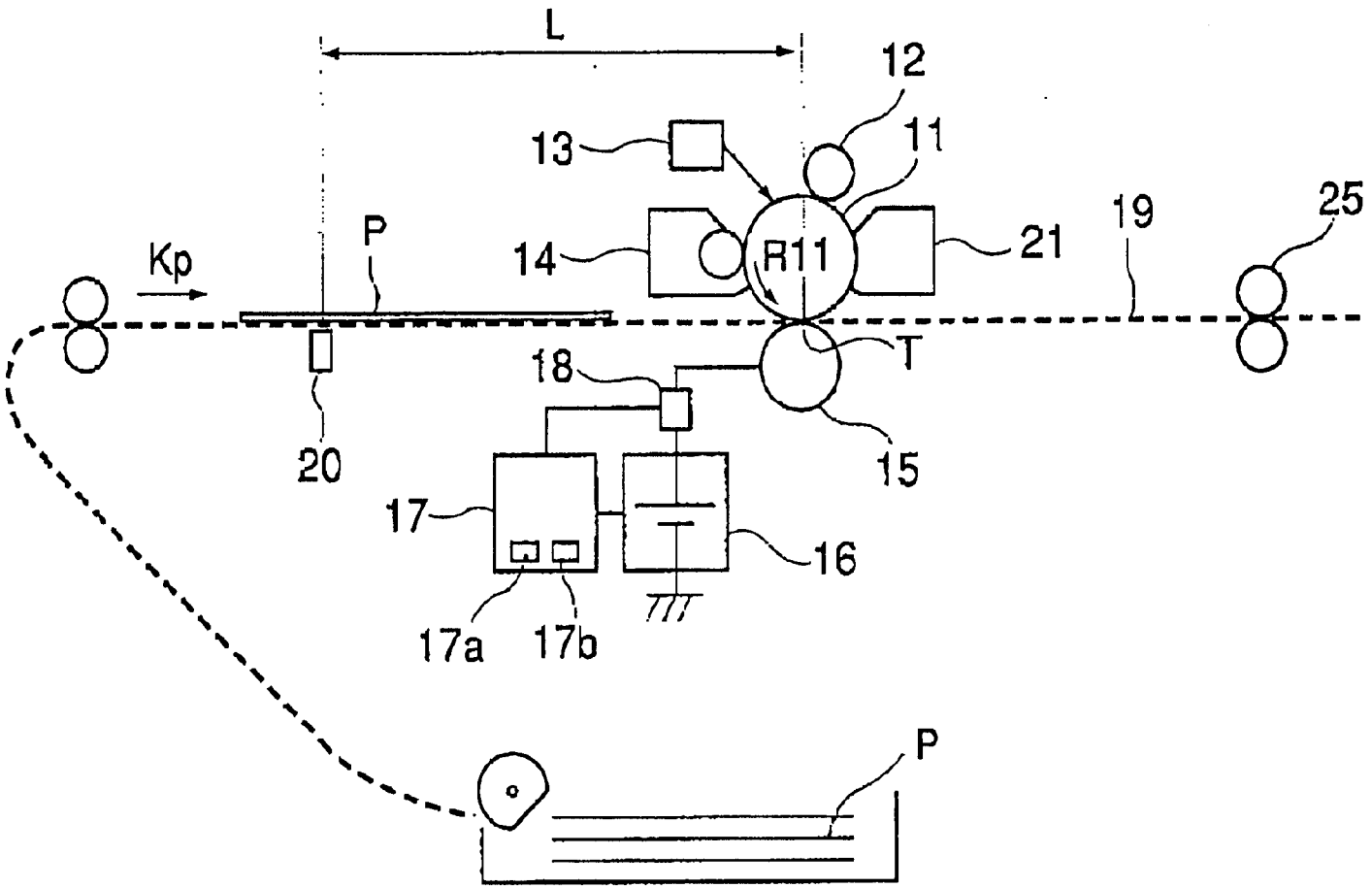
FIG. 4 is a schematic illustration of an image forming apparatus according to another embodiment of the present invention.
Figure 5:
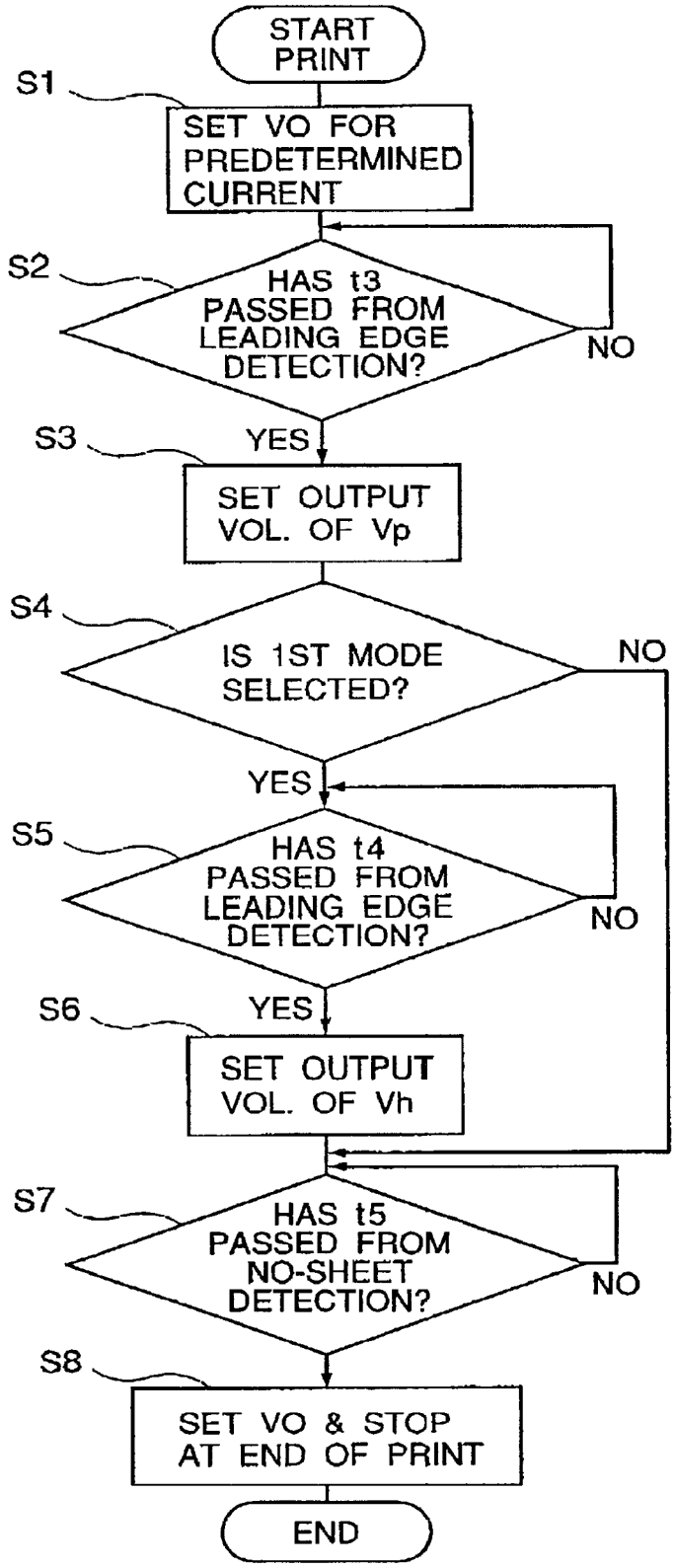
FIG. 5 is a flow chart of a transfer bias control according to this embodiment of the present invention.
Figure 6:
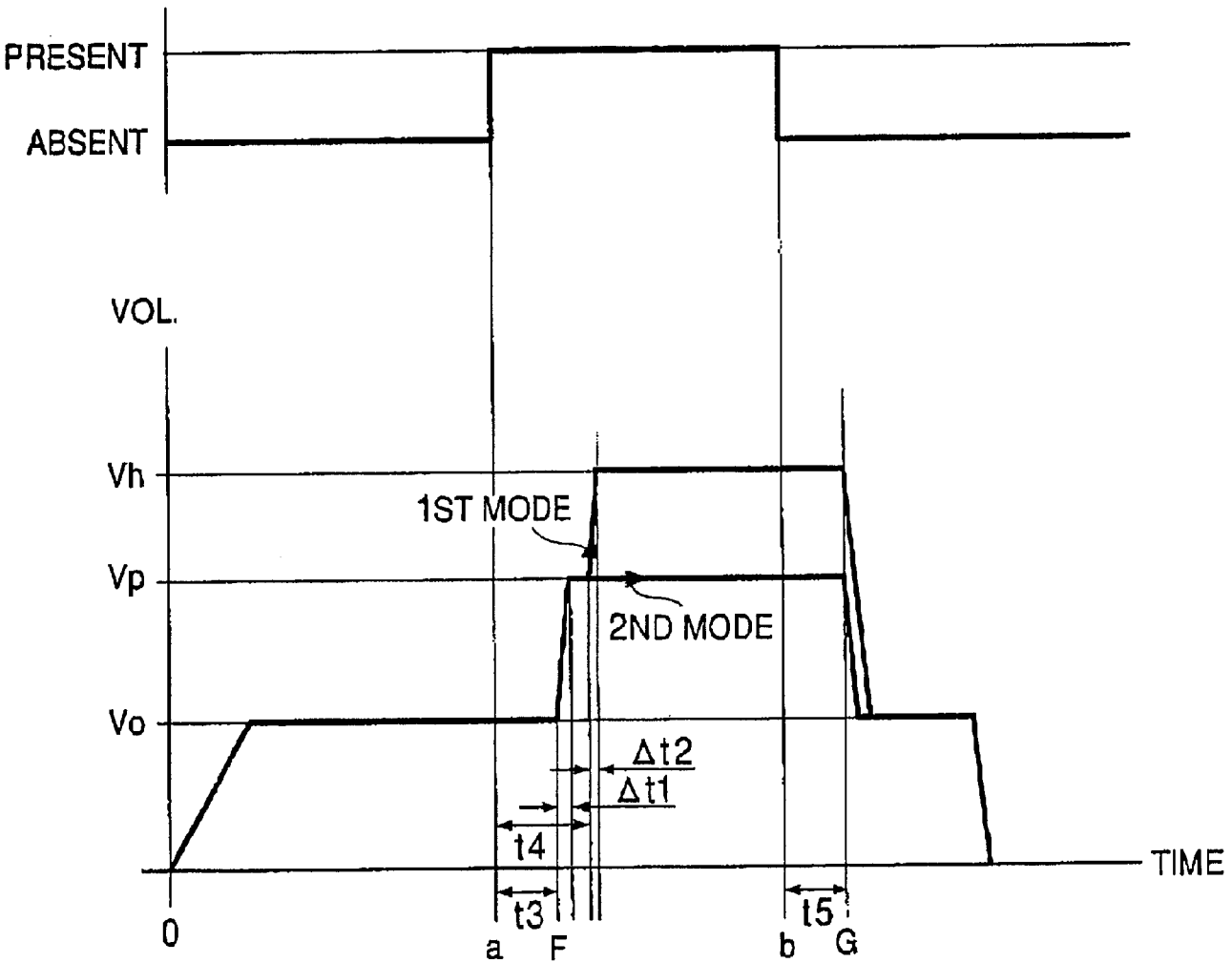
FIG. 6 is a timing chart of application of a transfer bias according to this embodiment of the present invention.
Figure 7:
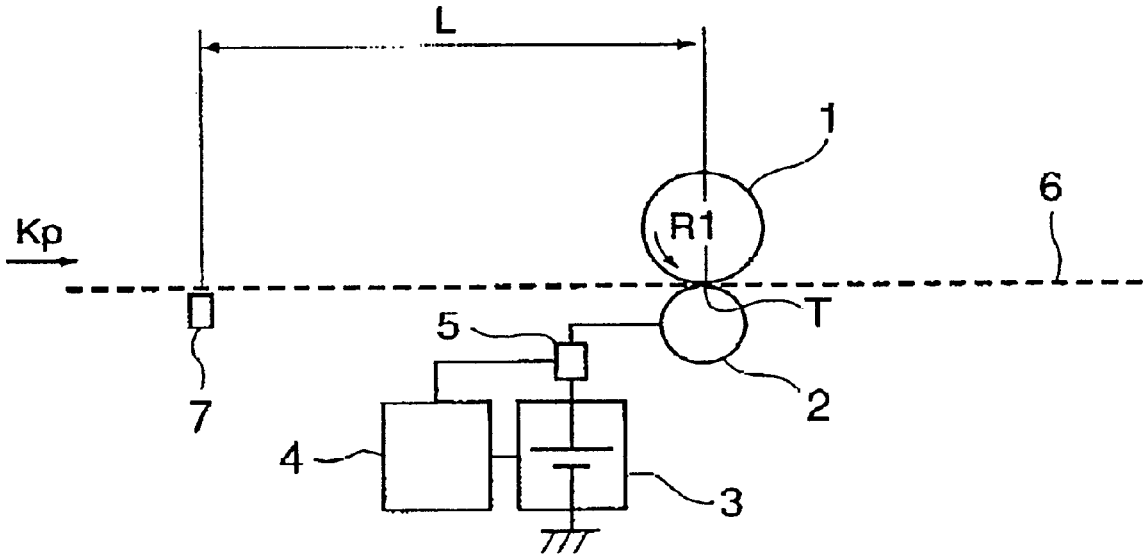
FIG. 7 is a schematic illustration of an image forming apparatus not using the present invention.
Figure 8:
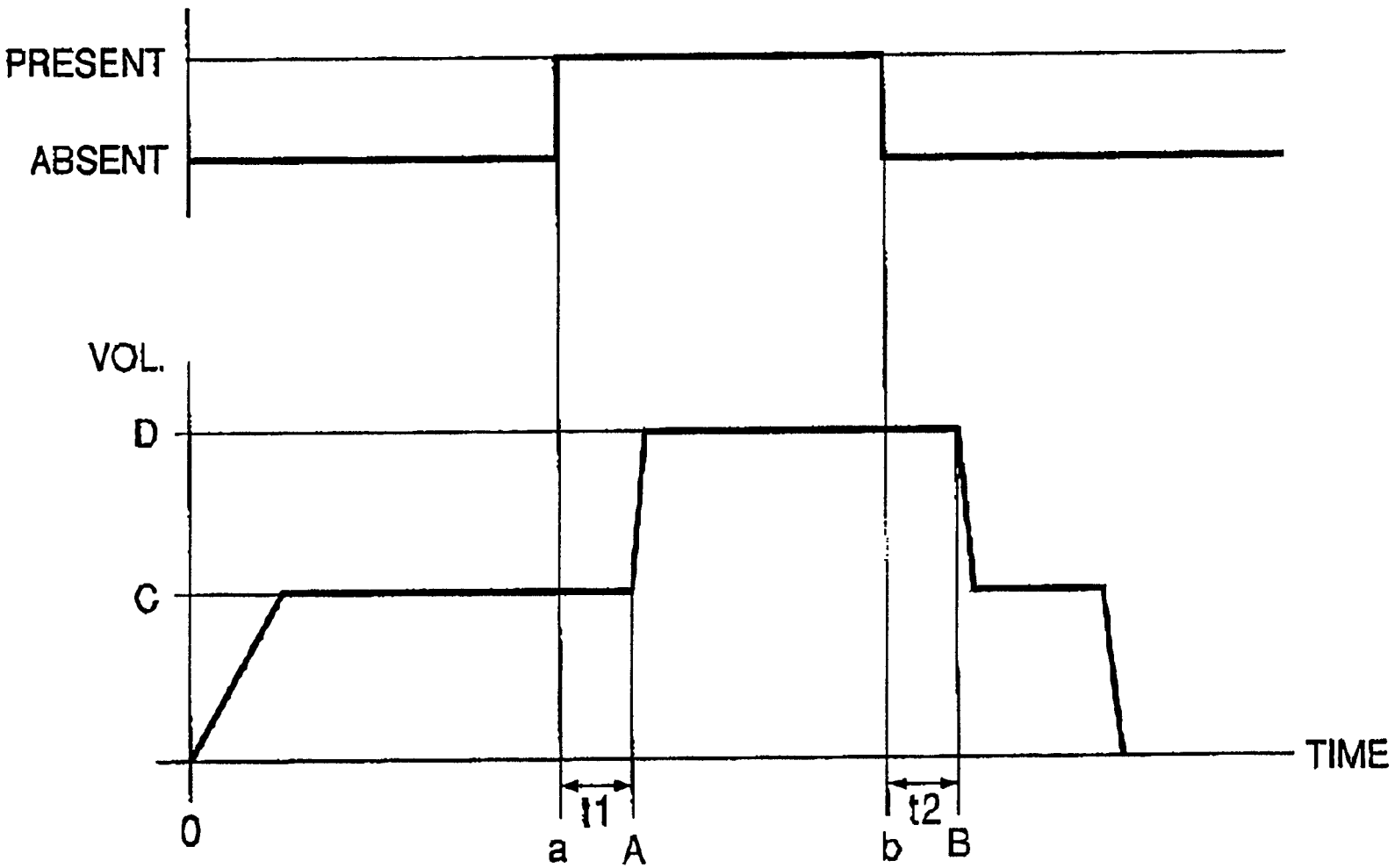
FIG. 8 is a timing chart of a transfer bias used in the apparatus of FIG. 7.

FIGS. 4, 5 and 6 show Embodiment 2. FIG. 4 is a schematic illustration of an image forming apparatus according to this embodiment of the present invention. The same reference numerals as in Embodiment 1 are assigned to the elements having the corresponding functions in this embodiment, and the detailed description thereof is omitted for simplicity.

In this embodiment, the control means 17 is provided with a switching means 17*b*. The control means 17 selectively effects, by switching means 17*b* a first mode in which the voltage is changed from VO to Vp and further to Vh similarly to Embodiment 1 (FIG. 6) and a second mode in which the voltage is maintained at Vp without providing Vh. The switching between the first mode and the second mode is carried out by the user.

Prior to the operation of image of image transfer from the surface of the photosensitive drum 11 onto the recording material P, the control means 17 activates the high voltage source 16 and effects the control such that current flowing through the current detecting means 18 is at a predetermined level. The voltage (first voltage) at the time when the current flowing through the current detecting means 18 is the predetermined value, is VO (S1 in FIG. 5). Subsequently, the voltage VO is maintained until the recording material sensor 20 detects the recording material P. The timing at which the recording material sensor 20 detects the sheet (presence of the recording material), is indicated by time an in FIG. 6. At time F which is t3 thereafter (S2), the control means 17 controls the high voltage source 16 such that high voltage source 16 produces a voltage Vp (second voltage) (S3). Here, t3 is set to be the time prior to the recording material P is nipped by the transfer nip T, more particularly, it is set to satisfy t3<L/S where L is a distance between the recording material sensor 20 and the transfer nip T, and S is a feeding speed of the recording material.

Then, if the first mode is selected by the user (S4), the control means 17 controls the high voltage source 16 so as to produce the voltage Vh (S5, S6) t4 after the timing of the detection of the presence of the sheet by the recording material sensor 20. Here, the t4 is selected such that recording material P is nipped in the transfer nip T, that is, t4 satisfies t4≧L/S. If the first mode is not selected (S4), the voltage Vp setting is maintained. Thereafter, when the recording material sensor 20 detects the absence of the sheet (t5 thereafter), control means 17 controls the high voltage source 16 to set the output voltage at VO, and the voltage supply is stopped at the end of the printing (S7, S8). Here, Vp=A, VO+B where An is a predetermined positive constant, and B is 0 or a predetermined positive constant), and Vh=C, VO+D where C and D are predetermined constants which are determined to satisfy Vh≧Vp within the range of variation of VO.

According to this embodiment, there is provided a switching means for switching between the first mode and the second mode, and therefore, in the case of the material of the sheet which does not require a very high-voltage for the transfer of the toner image from the photosensitive drum 11 onto the recording material, the voltage is not set at a very high-voltage, by which so-called toner scattering (if the voltage is too high, the toner jumps vigorously at the recording material, with the result of the toner scattering), can be avoided. In this not, this embodiment of the present invention is advantageous in that prop operations can be effected for various kinds of the recording materials.

In the foregoing embodiments, the switching means is actuated by the user. In an alternative, the kinds of the recording materials are automatically discriminated, and in response to the discrimination, the switching means may be automatically actuated.

In Embodiments 1 and 2, the reference signal providing a reference for the timing of switching the voltages Vp, Vh is determined using the recording material sensor disposed upstream-of the transfer nip. This is not inevitable, and the reference signal may be the sheet feeding start signal or the rotation start signal of the registration roller after the sheet feeding. The same effects can be provided if the switching timing is determined on the basis of the time having elapsed from the start of the recording material feeding. If the position of the recording material is known, the reference signal may be the print start signal.

In Embodiments 1, 2, the voltages Vp, Vh are determined by a linear equation. This is not inevitable, and another determination is usable if VO<Vp<Vh is satisfied.

As described in the foregoing, according to the present invention, the damage of the image bearing member attributable to application of high voltage to the image bearing member when there is no recording material in the transfer nip, can be avoided. Additionally, the voltage can be quickly raised to a high voltage, so that so-called transfer void attributable to the delay of the rising of the voltage can be avoided.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

an image bearing member;

a transferring member for transferring a toner image from said image bearing member onto a recording material at a transfer portion;

voltage applying means for applying a voltage to said transferring member, wherein said voltage applying means is capable of applying to the transferring member a first voltage, a second voltage higher than the first voltage and a third voltage higher than the second voltage, wherein said voltage applying means applies the first voltage to the transferring member, then the second voltage prior to the recording material reaching the transfer portion, and then the third voltage after the recording material reaching the transfer portion, and current detecting means for detecting a current flowing through said transferring member when said voltage applying means applies the voltage to said transferring member, wherein the first voltage is substantially equal to the voltage applied to said transferring member at the time when a current detected by said current detecting means is a predetermined value, and the second voltage and the third voltage are set on the basis of the first voltage.

2. An apparatus according to claim 1, switching from the first voltage to the second voltage, and switching from the second voltage to the third voltage, are carried out on the basis of a reference signal.

3. An apparatus according to claim 2, wherein switching from the first voltage to the second voltage is carried out a first period after receiving the reference signal, and switching from the second voltage to the third voltage is carried out a second period after receiving the reference signal.

4. An apparatus according to claim 2, further comprising recording material detecting means for detecting the recording material, and the reference signal is an output signal from said recording material detecting means.

5. An apparatus according to claim 2, further comprising recording material supplying means for supplying the recording material, wherein the reference signal is a supply start signal to said recording material supplying means.

6. An apparatus according to claim 2, further comprising registration means for temporarily stopping the recording material and refeeding the recording material to synchronize the recording material with the image on said image bearing member, wherein the reference signal is a feeding start signal to said registration means.

7. An apparatus according to claim 2, wherein the reference signal is an image formation start signal.

8. An image forming apparatus comprising:

an image bearing member;

a transferring member for transferring a toner image from said image bearing member onto a recording material at a transfer portion;

voltage applying means for applying a voltage to said transferring member, wherein said voltage applying means is capable of applying to the transferring member a first voltage, a second voltage higher than the first voltage and a third voltage higher than the second voltage, wherein said voltage applying means is operable in a first mode in which said voltage applying means applies to said transferring member the first voltage, then the second voltage prior to the recording material reaching said transfer portion, and then the third voltage after the recording material reaching said transfer portion, and in a second mode in which said voltage applying means applies to said transferring member the first voltage, then the second voltage prior to the recording material reaching said transfer portion, and then the second voltage after the recording material reaching the transfer portion, too; and switching means for switching between the first mode and the second mode.

9. An apparatus according to claim 8, wherein said switching means is operable by a user.

10. An apparatus according to claim 8, wherein said switching means is operated in accordance with kinds of the recording material.

11. An apparatus according to claim 8, further comprising current detecting means for detecting a current flowing through said transferring member when said voltage applying means applies the voltage to said transferring member, wherein the first voltage is substantially equal to the voltage applied to said transferring member at the time when a current detected by said current detecting means is a predetermined value.

12. An apparatus according to claim 8, wherein switching from the first voltage to the second voltage, and switching from the second voltage to the third voltage, are carried out on the basis of a reference signal.

13. An apparatus according to claim 12, wherein switching from the first voltage to the second voltage is carried out a first period after receiving the reference signal, and switching from the second voltage to the third voltage is carried out a second period after receiving the reference signals.

14. An apparatus according to claim 12, further comprising recording material detecting means for detecting a recording material, wherein the reference signal is an output signal from said recording material detecting means.

15. An apparatus according to claim 12, further comprising recording material supplying means for supplying the recording material, wherein the reference signal is a supply start signal to said recording material supplying means.

16. An apparatus according to claim 12, further comprising registration means for temporarily stopping the recording material and refeeding the recording material to synchronize the recording material with the image on said image bearing member, wherein the reference signal is a feeding start signal to said registration means.

17. An apparatus according to claim 12, wherein the reference signal is an image formation start signal.

18. An apparatus according to claim 11, wherein the second voltage and the third voltage are set of the basis of the first voltage.

* * * * *

UNITED STATES PATENT AND TRADEMARK OFFICE

CERTIFICATE OF CORRECTION

PATENT NO. : 6,654,570 B2
DATED : November 25, 2003
INVENTOR(S) : Hironori Kato

It is certified that error appears in the above-identified patent and that said Letters Patent is hereby corrected as shown below:

Column 1,
Line 52, “At” should be deleted.
Line 63, “material” should read -- in the --.

Column 2,
Line 4, “come” should read -- comes --.
Line 30, “quick” should read -- quickly --.
Line 35, “inventions” should read -- invention, --.

Column 3,
Line 52, “charger” should read -- a charger --.

Column 4,
Line 26, “and” should read -- an --.
Line 30, “transfer” should read -- transferred --.
Line 44, “2 Embodiment 1” should read -- Embodiment 1 --.

Column 5,
Line 37, “VO).” should read -- VO. --.
Line 49, “raise” should read -- raised --.

Column 6,
Line 5, “of image” (2nd occurrence) should be deleted.
Line 38, “constant),” should read -- constant, --.
Line 63, “upstream-of” should read -- upstream of --.

UNITED STATES PATENT AND TRADEMARK OFFICE

CERTIFICATE OF CORRECTION

PATENT NO. : 6,654,570 B2
DATED : November 25, 2003
INVENTOR(S) : Hironori Kato

It is certified that error appears in the above-identified patent and that said Letters Patent is hereby corrected as shown below:

Column 8,
Line 47, “signals.” should read -- signal. --.
Line 64, “set of” should read -- set on --.

Signed and Sealed this

Eighth Day of June, 2004

JON W. DUDAS
*Acting Director of the United States Patent and Trademark Office*